US009816188B2

(12) United States Patent
Curran et al.

(10) Patent No.: US 9,816,188 B2
(45) Date of Patent: Nov. 14, 2017

(54) PROCESS FOR THE ENHANCED CORROSION PROTECTION OF VALVE METALS

(75) Inventors: James Curran, Cambridge (GB); Stephen Hutchins, Earith (GB); Suman Shrestha, Haverhill (GB)

(73) Assignee: Keronite International Limited, Cambridge (GB)

( * ) Notice: Subject to any disclaimer, the term of this patent is extended or adjusted under 35 U.S.C. 154(b) by 1443 days.

(21) Appl. No.: 13/262,779

(22) PCT Filed: Mar. 30, 2010

(86) PCT No.: PCT/GB2010/050541

§ 371 (c)(1),
(2), (4) Date: Oct. 3, 2011

(87) PCT Pub. No.: WO2010/112914

PCT Pub. Date: Oct. 7, 2010

(65) Prior Publication Data

US 2012/0031765 A1 Feb. 9, 2012

(30) Foreign Application Priority Data

Apr. 3, 2009 (GB) ..... 0905791.0

(51) Int. Cl.

| | |
|---|---|
| ***C23C 22/78*** | (2006.01) |
| ***C25D 11/24*** | (2006.01) |
| ***C25D 11/30*** | (2006.01) |
| ***C25D 11/26*** | (2006.01) |
| ***B05D 3/14*** | (2006.01) |
| ***C25D 11/16*** | (2006.01) |
| ***C23C 22/82*** | (2006.01) |
| ***C25D 11/02*** | (2006.01) |

(52) U.S. Cl.

CPC ..... *C23C 22/78* (2013.01); *B05D 3/142* (2013.01); *C23C 22/82* (2013.01); *C25D 11/026* (2013.01); *C25D 11/16* (2013.01); *C25D 11/24* (2013.01); *C25D 11/26* (2013.01); *C25D 11/30* (2013.01); *B05D 2202/20* (2013.01); *B05D 2202/25* (2013.01); *B05D 2202/30* (2013.01)

(58) Field of Classification Search

CPC ..... C25D 11/026; C25D 11/16; C25D 11/30; C25D 11/26; C25D 11/24; C23C 22/82; C23C 22/83; C23C 22/78; B05D 2202/30; B05D 2202/25; B05D 2202/20; B05D 3/142

USPC ..... 205/188–190

See application file for complete search history.

(56) References Cited

U.S. PATENT DOCUMENTS

| | | | | |
|---|---|---|---|---|
| 2,322,208 | A | 6/1943 | Loose et al. | |
| 3,962,061 | A * | 6/1976 | Nikaido et al. | 205/704 |
| 4,744,872 | A | 5/1988 | Kobayashi et al. | |
| 5,240,589 | A * | 8/1993 | Bartak et al. | 205/321 |
| 5,470,664 | A | 11/1995 | Bartak et al. | |
| 6,247,228 | B1 * | 6/2001 | Distefano | H01L 23/49827 257/E23.067 |
| 6,365,028 | B1 * | 4/2002 | Shatrov | 205/102 |
| 2002/0104761 | A1 | 8/2002 | Birss et al. | |
| 2002/0112962 | A1 * | 8/2002 | Beauvir | C25D 11/026 205/102 |
| 2003/0127338 | A1 * | 7/2003 | Beier-Korbmacher et al. | 205/229 |
| 2003/0188972 | A1 * | 10/2003 | Shatrov | C25D 5/18 205/91 |
| 2006/0013986 | A1 * | 1/2006 | Dolan | 428/54 |
| 2006/0016690 | A1 | 1/2006 | Ostrovsky | |
| 2009/0174987 | A1 * | 7/2009 | Mizuno | C23C 14/165 361/529 |
| 2011/0048965 | A1 * | 3/2011 | Yun | C25D 11/30 205/724 |

FOREIGN PATENT DOCUMENTS

| | | | |
|---|---|---|---|
| CA | 2540340 | A1 * | 9/2007 |
| CN | 101376998 | A | 3/2009 |
| EP | 1231299 | A1 | 8/2002 |
| EP | 1793019 | A2 | 6/2007 |
| WO | 9612052 | | 4/1996 |
| WO | 9612052 | A1 | 4/1996 |
| WO | 9705302 | A1 | 2/1997 |

OTHER PUBLICATIONS

International Search Report for International Application PCT/GB2010/050541 dated Jun. 10, 2010 (3 pgs.).

* cited by examiner

*Primary Examiner* — Louis Rufo
(74) *Attorney, Agent, or Firm* — Shumaker & Sieffert, P.A.

(57) ABSTRACT

A process for the corrosion protection of metals such as magnesium, aluminium or titanium, where at least two steps are used, including both plasma electrolytic oxidation and chemical passivation. The combination of these two processing steps enhances the corrosion resistance performance of the surface beyond the capability of either of the steps in isolation, providing a more robust protection system. This process may be used as a corrosion protective coating in its own right, or as a protection-enhancing pre-treatment for top-coats such as powder coat or e-coat. When used without an additional top-coat, the treated parts can still retain electrical continuity with and adjoining metal parts. Advantages include reduced cost and higher productivity than traditional plasma-electrolytic oxidation systems, improved corrosion protection, greater coating robustness and electrical continuity.

11 Claims, No Drawings

PROCESS FOR THE ENHANCED CORROSION PROTECTION OF VALVE METALS

CROSS REFERENCE TO RELATED APPLICATION

This is a National Stage filing under 35 U.S.C. 371 of International Application No. PCT/GB2010/050541, filed Mar. 30, 2010, which claims priority to GB Application No. 0905791.0, filed Apr. 3, 2009.

This invention relates to a process of surface treatment for the corrosion prothection of any metals which can be processed by plasma-electrolytic oxidation (alternatively micro-arc oxidation, spark anodising or similar processes) to form a surface oxide layer.

BACKGROUND

Such metals, sometimes referred to as "valve" metals include for example magnesium, aluminium, titanium, tantalum, zirconium, chromium, vanadium, cobalt, hafnium, molybdenum and any of their alloys. The resultant oxide layer provides some degree of corrosion protection because it constitutes a physical barrier between the metal and the corrosive environment. An alternative route for the protection of these metals is chemical passivation, whereby a thin film is formed on the metal surface by chemical reaction. Such films can provide continued, active, corrosion protection by reacting preferentially with any freshly exposed metal that might arise through mechanical action or corrosion.

Plasma electrolytic oxidation technology is a development of more conventional anodising technology, where different electrolytes are used and higher potentials and current densities (typically 10 to 200 $mAcm^{-2}$ as compared to 1-2 $mAcm^{-2}$ for more conventional anodising) are applied in order to achieve microscopic plasma discharges which modify the growing oxide film. It is sometimes also referred to as micro-arc oxidation, spark anodising or discharge anodising and other combinations of these terms. The technology has been developed for the surface protection of a wide range of metals, known as "valve" metals. These are metals which exhibit electrical rectifying behaviour in the electrolytic cell: under a given applied current, they will sustain a higher potential when anodically charged than when cathodically charged. Such metals include aluminium, magnesium, titanium, zirconium, hafnium, chromium, cobalt, molybdenum, vanadium and tantalum for example and their alloys.

Known processes for plasma electrolytic oxidation include: U.S. Pat. No. 3,293,158 (Anodic spark reaction processes and articles—McNeill et al.), U.S. Pat. No. 5,792,335 (Anodization of magnesium and magnesium based alloys—Barton et al.), U.S. Pat. No. 6,365,028 (Method for producing hard protection coatings on articles made of aluminum alloys—Shatrov), and U.S. Pat. No. 6,896,785 (Process and device for forming ceramic coatings on metals and alloys, and coatings produced by this process—Shatrov et al.).

There are many patented and commercial variants of this process, the main variants being the applied electrical regime and electrolyte. Electrical regimes include direct current, pulsed direct current and a wide range of pulsed or alternating current regimes. Electrolyte systems are also very varied but the most commercially successful systems are aqueous, alkaline solutions. Several viable processes are described within the prior art of U.S. Pat. No. 6,365,028. For example, U.S. Pat. No. 5,616,229 specifies a modified sine wave form at industrial (50-60 Hz) frequency from a source of at least 700V, and electrolytes consisting of KOH (at 0.5 g/l) with up to 11 g/l of sodium tetrasilicate. This is one of the simpler electrolyte systems and is not stable. U.S. Pat. No. 6,365,028 employs a more stable electrolyte consisting of an aqueous solution of an alkaline metal hydroxide at 1-5 g/l, an alkali metal silicate at 2-15 g/l, an alkaline metal pyrophosphate at 2-20 g/l and peroxide compounds at 2-7 g/l.

The benefits of plasma electrolytic oxidation of a surface include both mechanical protection and corrosion protection. The mechanical protection is due to the formation of a hard, well-adhered layer of ceramic. The oxide layers tend to be significantly harder than more conventional hard anodised layers because the plasma discharge processes convert amorphous oxides into harder crystalline forms such as the alpha phase of alumina.

Because plasma electrolytic oxide films constitute a corrosion resistant, barrier layer of oxide on the surface of a metal, they present a protective barrier which isolates that metal from any corrosive environments. As such, they can extend the life of metal components in environments which would otherwise result in rapid corrosion and degradation of the metal surfaces.

It is known, for example from CA2540340, to improve a coating process by pre-treating the surface of an aluminium product by first forming a thin, dense and non-porous alumina barrier layer (dielectric layer) through anodizing, electrolytic oxidation, chemical oxidation, physical vapour deposition and/or chemical vapour deposition. A modification substance layer comprising metal oxide, carbide, boride, nitride, silicide and/or solid lubricant or composites is formed on top of the alumina barrier layer by the same techniques, or by powder spray techniques. Once the surface has been prepared in this way, micro-arc oxidation is commenced, the resulting oxide coating being said to be improved over an oxide coating formed on an untreated aluminium surface. The modification substance layer is said to promote micro-arc fusing, to promote oxide growth, to provide permanent lubrication or hardening and to improve smoothness/hardness so as to reduce the need for subsequent machining. There is no mention whatsoever of corrosion inhibition or chemical passivation.

The main weakness of plasma electrolytic oxide films in terms of corrosion protection is that they are mere physical barriers, and as soon as they are physically breached, they leave an area of the substrate exposed to the environment and vulnerable to corrosive attack. For this reason, sealers and top-coats are often applied to provide a less permeable, thicker and/or tougher barrier. These exploit the fine and varied surface-connected pore structure of the micro arc oxide films [see e.g. "Porosity in plasma electrolytic oxide coatings", J. A. Curran and T. W. Clyne, Acta Materialia 54 (2006) pp 1985-1993] which enables impregnation to form a composite layer or intimate bonding of a top-coat.

Typical sealer systems used in conjunction with plasma electrolytic oxide coatings include a wide range of polymers including but not limited to fluoropolymers (e.g. DE4124730 Intercalation of fluorinated polymer particles—into microporous oxide surfaces of aluminium, magnesium and aluminium magnesium alloy objects for homogeneous coating of polymers—AHC Oberflachentechnik), acrylic, epoxy, polyester, polysiloxanes and PVDF. These are typically applied in the form of electrostatically sprayed powder coats, by electrophoretic deposition (e.g. WO 99/02759

—Sealing procedures for metal and/or anodised metal substrates—MacCulloch and Ross), or simply by dipping or wet spraying. "Primer" systems such as tetra methyl silane will often be used as an intermediate treatment to enhance the adhesion of polymeric top-coats. Inorganic sealing or top-coating treatments for plasma electrolytic oxide coatings include silica (which is typically applied in the form of an aqueous sodium silicate solution dip), and sol-gels. Lubricants are often applied to plasma electrolytic oxide coatings to fill pore structures while enhancing tribological performance. These include oil-based lubricants but also solid state lubricants such as graphite, boron nitride (BN), or molybdenum disulphide ($MoS_2$), and numerous polymeric lubricants such as the previously mentioned PTFE dispersions. Even top-coats of metals such as nickel have been used in conjunction with plasma electrolytic oxide coatings (WO 01/12883 Light alloy-based composite protective multifunction coating—Shatrov et al), and these may be applied by techniques as diverse as plasma spraying, electroplating, and electroless deposition.

This is similar to the development of duplex systems with anodising, as described in U.S. Pat. No. 5,439,747 and U.S. Pat. No. 6,905,775.

WO 97/05302 discloses a post treatment for a micro-arc or plasma-electrolytic oxidation coating in which the coating is physically sealed using a silicic acid sol gel. The sol gel is used to seal porosity in the coating, and any chemical activity arising from compounds in the sol gel is confined to reaction with the oxide coating, with no regard being given to the underlying metal. While passing mention is made of the optional provision of corrosion inhibitors in the sol gel, it is clear that such corrosion inhibitors (which are not disclosed in any detail) are limited to those that can be incorporated in a silicic acid sol gel that is used for post-sealing the pores of a micro-arc oxidation or PEO coating.

U.S. 2006/0016690 discloses a micro-arc oxidation process in which additional compounds or moieties are included in the liquid electrolyte with the intention of, among other things, improving corrosion resistance. This is a "one step" process—there is no separation of chemical and physical treatment steps.

Another post-treatment for PEO coatings is known from EP1231299 to the present Applicant. This discloses the incorporation of various functional components including various transition element metals and their carbides, oxides, nitrides, borides and silicides into the pores of the PEO coating. The purpose of these components is to reduce friction and to provide resistance to wear and scratching, not to enhance corrosion protection. While resistance to wear and scratching will in itself provide some passive corrosion resistance, there is no disclosure of any mechanism for active corrosion protection or chemical passivation in the event of a breach in the oxide layer exposing the underlying metal.

None of these systems for the enhancement of micro arc oxide layers includes a chemically active agent, designed to afford continued active protection to the metal in the event of a physical breach of the oxide layer. The function of the secondary treatments in existing plasma electrolytic oxidation technology is to physically seal the pore structure, to promote the adhesion of further top-coat systems, to physically augment the protective coating in terms of thickness or mechanical robustness, or to modify physical attributes of the layer (such as its wear performance, friction coefficient, toughness, colour, reflectivity, electrical continuity etc.).

Chemical conversion or passivation is a well-developed technology for the corrosion protection of metals, in its own right. It is often also used as pre-treatment for further polymeric top-coats. The most effective system for the chemical conversion treatment of aluminium and magnesium, for example, is chromate conversion treatment. Typical examples include chromic acid/chromate treatments such as a solution of chromic acid ($CrO_3$) and hydrofluoric acid (HF), often with an accelerator. An alternative is phosphoric acid/chromate treatment such as that disclosed in U.S. Pat. No. 2,438,877 where the conversion treatment solution is composed of chromic acid ($CrO_3$), phosphoric acid ($H_3PO_4$) and hydrofluoric acid (HF). This solution produces a protective surface film of chromium phosphate ($CrPO_4.4H_2O$).

Chromate based conversion coatings such as those described above and that described in U.S. Pat. No. 5,451,271 have been widely adopted by industry for the corrosion protection of metals such as aluminium, magnesium and their alloys. However, the high toxicity of chromate based systems has necessitated their replacement and the development of a wide range of alternatives such as zinc phosphate based conversion coating and other systems including fluorides and zirconates and titanates for example. Zinc phosphate conversion coatings are formed by exposing a clean, active metal surface to an aqueous acidic solution containing zinc and phosphate ions. For example, the result of a mixture in water of zinc oxide and phosphoric acid results in a solution containing zinc dihydrogen phosphate ($Zn(H_2PO_4)_2$). The zinc dihydrogen phosphate complexes with the metal surface to form a protective film containing zinc phosphates. There are many patented and commercial embodiments of zinc phosphating, many of which include a polyhydric polymer to quench the reactivity of the phosphating composition and aid wetting of the substrate, and other additives to aid the adhesion of further sealants or top-coat films. Examples include U.S. Pat. Nos. 5,261,973 , 5,378,292, and U.S. Pat. No. 6,117,251.

Other phosphate-based conversion processes include those disclosed in U.S. Pat. Nos. 4,264,378 and 5,520,750 (e.g. phosphate/vanadate, phosphate/tungstate or phosphate/molybdate processes), and U.S. Pat. No. 5,595,611 (a manganese phosphate conversion coating). U.S. Pat. Nos. 5,683,522 and 6,887,320 for the conversion coating of magnesium describe processes where both phosphate and fluoride ions are used in solution to form a conversion coating of magnesium phosphate ($Mg_3(PO_4)_2$) and magnesium fluoride ($MgF_2$).

In addition to chromate or phosphate based systems, passivation of metals such as aluminium or magnesium may be achieved using complex fluorides of elements such as titanium, zirconium, hafnium, silicon or boron, as exemplified by U.S. Pat. Nos. 4,298,404 and 5,584,946.

Furthermore, some chemical conversion coatings are designed to promote adhesion of a polymeric topcoat. Unfortunately, many of those designed to fulfil this function, have poor passivation performance, leading to corrosion problems if the top coat is breached. With the proposed invention, the user may use the best chemical passivation techniques, since the topcoat adhesion will be supplied by the plasma electrolytic oxide layer.

All of the chromate-free chemical conversion coatings fail to match the performance that has become expected by users of chromate based systems, as demonstrated in industry test programmes such as that reported in "Evaluation of Corrosion Protection Methods for Magnesium Alloys", Blanchard P. J. et al., Magnesium Technology 2005, TMS (The Minerals, Metals & Materials Society) 2005.

Moreover, none of the proponents of chemical passivation identifies a synergistic combination of the two technologies. Indeed, U.S. Pat. No. 5,683,522 above explicitly describes both the shortcomings and difference of electrolytic oxidation as compared to chemical conversion, concluding that a non-electrolytic process is more suitable: "with complex shapes, as in the case of aircraft generator housings, non-uniform coatings are formed from the process of anodizing, as internal areas on the housing are either left uncoated or extremely thin, while other areas near the current application exhibit excess build-up of coating. In addition to forming non-uniform coatings, an electrolytic process does not tolerate dissimilar metals being in contact with a magnesium product during the coating step. [. . .] Inserts must be masked during the anodizing process, and when the mask is removed, an area of magnesium surrounding the insert is left uncoated.". This is typical of the present state-of-the-art, and of the approach of those experienced in the art of corrosion and wear protection of these metals: there exist two separate protection routes, each with perceived advantages and disadvantages, and with no compatibility or synergy.

While modern plasma electrolytic oxide coatings can satisfy typical corrosion protection requirements in their own right (as shown in the Blanchard et al work), the very different nature of the corrosion protection they afford presents difficulties and prompted the development of the present invention which overcomes some of the main limitations of each of the hitherto competing technologies of electrolytic oxidation and chemical passivation.

BRIEF SUMMARY OF THE DISCLOSURE

According to a first aspect of the present invention, there is provided a process for providing corrosion protection to items made from magnesium, aluminium, titanium, and other valve metals and alloys, the process comprising at least a plasma electrolytic oxidation step and a chemical passivation step.

The chemical passivation step may precede the plasma-electrolytic oxidation step, or the plasma-electrolytic oxidation step may precede the chemical passivation step.

Alternatively, chemical passivation steps may be performed both prior to and after the plasma-electrolytic oxidation step.

In particularly preferred embodiments, a coating is formed that allows electrical continuity with adjoining metal parts. In some embodiments, the coating may be electrically conductive or at least allow a degree of electrical or galvanic conduction through the coating to the underlying metal, possibly by way of surface asperities.

Some or all of the surface of the item may be treated with the plasma-electrolytic oxidation step, and/or some or all of the surface of the item may be treated with the chemical passivation step.

The process may further comprise a pre-treatment regime of degreasing, etching and/or de-smutting to provide a clean metal surface for the subsequent plasma electrolytic oxidation and chemical passivation steps.

Alternatively or in addition, the process may further comprise a post-treatment regime consisting of rinses in water, preferably controlled purity water, pH-neutralising rinses, primer and/or sealer solutions.

In some embodiments, the process further comprises application of subsequent polymeric sealers and top-coats including but not limited to liquid paint, electrophoretic paint, powder coat or PTFE impregnation.

According to a second aspect of the present invention, there is provided a protective surface layer formed by the process of the first aspect.

The protective surface layer may comprising a protective oxide barrier film on the surface of a metal component, particularly on edges and sharp convex radii, and which is impregnated with a chemical passivating agent which provides active corrosion protection in the event of physical breach of the barrier oxide.

According to a third aspect of the present invention, there is provided a product coated with a protective surface layer formed by the process of the first aspect, or with a protective surface layer of the second aspect.

Both plasma electrolytic oxidation and chemical passivation can significantly prolong the service life of metallic components in corrosive environments, but each has limitations which eventually allow accelerated corrosion of the surface. This invention describes a process which has been developed to overcome some of the common limitations of each of these techniques.

One advantage of the invention over known chemical passivation processes is reduced sensitivity to the cleanliness of the substrate metal because of the electrochemical cleaning action introduced by the plasma electrolytic oxidation process regime. Another advantage is greater mechanical robustness of the protective film: the surface hardening affect of the relatively thick plasma electrolytic oxide film provides mechanical protection for the relatively thin and mechanically insignificant film of chemical passivating agent. This enhanced mechanical robustness is greatest and most significant on edges and sharp convex radii where chemical passivation systems are often least effective. A third advantage of the present invention over chemical passivation technology is the greater retention of passivation agent on the surface. The plasma electrolytic oxidation step provides a high surface area which is readily impregnated and retains significantly higher volumes of the passivating agent than a bare metal surface.

The main advantage of the present invention over known plasma electrolytic oxidation technology is the enduring active behaviour of the chemical passivating agent. Plasma electrolytic oxide films are vulnerable to mechanical damage, sometimes created by corrosion reactions themselves. Mechanical damage can expose the substrate metal to a corrosive environment. In the present invention, the oxide barrier film may be heavily impregnated with chemical passivating agent to the extent that and freshly exposed metal immediately reacts preferentially with the chemical passivating agent and is thus protected against further corrosive attack.

The incorporation of a chemically active passivating compound into the plasma electrolytic oxide coating enables the use of thinner plasma electrolytic oxide coatings which can still match or better the performance of existing chemical conversion solutions. Thus, plasma electrolytic oxide barrier layers may be thin enough to allow electrical continuity with adjoining metal parts. This extends possible applications of plasma electrolytic oxide coating technology to include applications such as radio frequency shielding components or spot-weldable components.

Embodiments of the present invention provide a sequence of processing steps and processing conditions which overcome some of the main limitations of the prior art in terms of corrosion protection. Processing routes have been developed to combine hitherto separate technologies of plasma electrolytic oxidation and chemical passivation. The result is a surface treatment layer which combines the mechanical robustness and edge protection of a plasma electrolytic oxide layer, and its insensitivity to surface pre-treatment, with the active chemical protection afforded by chemical passivating agents, and a physical reserve of the chemically active agent. The resulting layer provides a remarkably more robust and more enduring corrosion protection than the prior art. Furthermore, plasma electrolytic oxidation coatings are traditionally promoted for their electrical insulating properties. However, a surprising benefit of embodiments of the present invention is that, because the resulting layer can match or exceed the corrosion performance of existing plasma electrolytic oxide films at relatively low thicknesses, it widens applications of plasma electrolytic oxidation to include those where electrical continuity with adjoining metal parts is a requirement. These include radio frequency shielding components and spot-weldable components. A further benefit of good electrical continuity is that the parts can be easily post-processed by processes that require the use of electricity such as electroplating and electrophoretic or electrostatic painting, while a further benefit over existing plasma electrolytic oxidation technology is the improved performance of thin layers which enables shorter processing times, greater processing efficiency, or lower process costs.

In embodiments of the present invention, the additional treatment serves primarily to enhance the corrosion protection of the plasma electrolytic oxide coating through chemical means, for example by providing a source of a chemically active compound which will passivate any exposed substrate metal. Thus, the process differs significantly from any existing plasma electrolytic oxide based corrosion protection systems.

It is particularly to be appreciated that, in preferred embodiments, the chemically active compound is selected to provide corrosion protection to the underlying substrate metal, rather than to the plasma electrolytic oxide coating itself.

Moreover, preferred embodiments of the present invention specifically exclude application of the chemical passivating agent by way of a sol gel. Moreover, preferred embodiments of the present invention, particularly those in which the chemical passivation step is carried out after the plasma electrolytic oxidation step, do not seal the pores of the plasma electrolytic oxide coating or layer. Instead, the purpose of the chemical passivation step is to provide a source of active chemical passivating agents that become available to passivate the underlying metal substrate surface in the event of a breach of the oxide coating or layer.

It is further to be appreciated that incorporation of metals and/or refractory compounds in the oxide coating or layer as, for example, disclosed in EP1231299 may in some cases actually lead to accelerated corrosion of the underlying metal substrate due to galvanic action in the event of the oxide coating being breached.

DETAILED DESCRIPTION

Magnesium, aluminium, and titanium, and their alloys are all susceptible to corrosion under certain environmental conditions. Their corrosion resistance can be significantly enhanced by either of the two main categories of surface treatment processes described in the prior art: chemical passivation and plasma electrolytic or micro-arc oxidation. However, each of these surface protection processes has limitations which can be overcome by embodiments of the present invention.

Chemical passivation, using the systems described in the prior art (and in commercial practice, proprietary chemical systems such as Henkel's Alodine™ 5200, or Chemetall's Gardobond™ X4707), provides enhanced corrosion protection by rendering the surface less chemically susceptible to corrosion processes. The chemicals act through a combination of chemical surface conversion and deposition of a thin layer of protective compounds such as chromates, fluorozirconates or phosphates which will react preferentially with any exposed metal surface to provide lasting, active protection of the metal against a corrosive environment. The most efficient chemical passivation treatments are those involving chromates but these are now of limited popularity due to their toxicity, so phosphate and fluoride based passivation systems are now more common though less effective.

Among the limitations of the chemical passivation processes is their susceptibility to mechanical damage. The thin chemical conversion coatings present no significant mechanical performance enhancement to the metal surface because they are such thin, soft, layers. Furthermore, they are highly susceptible to the cleanliness of the metal surface onto which they are deposited. Any greases, dye lubricants or mould release agents from metal forming processes, or any significant levels of pre-existing corrosion products such as oxides present a physical barrier to the chemical passivation solutions. In typical applications, particularly on magnesium, a pre-treatment or sequence of pre-treatment steps is performed to sequentially de-grease, etch or "deoxidise" and de-smut the metal surfaces to leave a clean metal surface immediately prior to the chemical passivation step. Examples are given in U.S. Pat. No. 5,683,522. Nevertheless, some alloys such as AE44 magnesium prove particularly difficult to clean sufficiently for typical commercial products and the resulting passivated film is discontinuous and provides limited corrosion resistance.

Convex corners or any sharp radii on parts provide additional problems for chemical passivation processes because, as with many fluid deposition processes, surface tension results in a thinning effect whereby the deposited layer is thinner on such features. This again results in a non-uniform film and in areas of relatively poor protection. These convex corners may be particularly vulnerable to corrosion because they are likely to occur on exposed edges where liquid corrosive agents may accumulate or where mechanical damage to parts is more likely. In corrosion testing (e.g. ASTM B117 neutral salt spray exposure), it is common for corrosion to initiate at such features. Many topcoats applied to the passivated part suffer from the same thinning on edges and corners and this makes matters worse.

The Keronite® plasma electrolytic oxidation (PEO) process (as embodied in U.S. Pat. Nos. 6,365,028 and 6,896,785 for example) is a proprietary process which is widely used in industry to form a relatively thick, hard, protective oxide film by surface conversion of the magnesium, aluminium and titanium into corresponding oxides. On aluminium alloys, for example, alumina is formed, in both amorphous and extremely hard crystalline forms. On magnesium and its alloys, magnesia is formed, sometimes with magnesium aluminium spinels to incorporate any aluminium in the substrate metal. Anomag™ (as embodied in U.S. Pat. No. 5,792,335) is another proprietary process for micro arc oxidation technology, which forms a magnesium phosphate coating on magnesium. They are both electrolytic immersion processes which employ high potentials and high current densities to induce micro plasma discharges which modify the growing oxide film.

Generally speaking, the PEO processes convert the metal surface into an oxide layer which presents a protective barrier against corrosion by isolating the substrate metal from corrosive environments. Because it is a hard yet compliant, semi-crystalline oxide ceramic, the PEO layer provides a level of mechanical protection to the substrate metal. On magnesium and aluminium, for instance, PEO films can significantly out-perform tool steel or hard anodised aluminium in terms of sliding wear or abrasive wear protection as demonstrated by testing equivalent thicknesses of each coating type according to ASTM G99 and G65 respectively.

The surface hardening and other protection is particularly good on edges or sharp convex radii, which naturally result in enhanced electrical field strength on any non-spherical metal component. This enhanced electrical field strength is a preferential state for plasma electrolytic oxidation and accelerates the process, resulting in enhanced growth and oxide layer thickness on such features. Thus, enhanced mechanical robustness is provided for edges and sharp convex radii. This effect can be promoted further by selecting specific processing regimes which enhance the thickness of edges over that of plane surfaces.

The Keronite® or Anomag™ PEO processes also result in a fine network of surface-connected pores which greatly enhance the surface area of the processed part and facilitates liquid impregnation and top-coat adhesion ["Porosity in plasma electrolytic oxide coatings", J. A. Curran and T. W. Clyne, Acta Materialia 54 (2006) pp 1985-1993]. This is of benefit when using the plasma electrolytic oxide layer as a pre-treatment for powdercoat, e-coat, or the other top-coats described in the prior art, but is also immediately relevant to the treatment of the coating with chemical passivation agents. The plasma electrolytic oxide layer's fine, permeable, pore structure is readily wetted by many liquid systems, including a wide range of known chemical passivation agents (such as zinc dihydrogen phosphate ($Zn(H_2PO_4)_2$), fluorozirconates and chromates and others described in the prior art). As a result, whenever a plasma electrolytic oxidation step is performed on a component's surface prior to immersion in a chemical passivating agent, the quantity of chemical passivating agent retained in the resulting composite layer is significantly higher than for a bare metal surface. The composite layer of plasma electrolytic oxide and chemical passivating agent thus has a significant reserve of chemical passivating agent, which can provide enduring active chemical passivation to the underlying metal whenever a physical breach of the barrier film occurs.

A limitation of PEO surface treatments in terms of corrosion protection is that, like any barrier film protection, they are vulnerable to corrosion whenever the barrier film is breached. This is where the presence of passivating chemical compounds in the layer can offer continued, lasting protection.

This is one of the benefits of embodiments of the present invention, examples of which combine the barrier film effect and the mechanical robustness of the Keronite® or Anomag™ micro arc oxide layer with the chemical protection afforded by the chemical passivation agent. It is of particular significance that the plasma electrolytic oxidation processes offer enhanced edge protection while this is an area of weakness for many chemical passivation systems. Thus, in each of these cases, one of the treatment systems is enhancing a weakness of the other, thereby providing a surprisingly advantageous technical effect.

Another significant benefit of the duplex process is that the plasma electrolytic oxidation processes, by virtue of their high energy density, are able to electrochemically clean the metal surface, making the duplex coating system less susceptible to surface contamination and to the quality of cleaning pre-treatments.

This is particularly significant on alloys such as the magnesium rare-earth alloy AE44 where even lengthy pre-treatment sequences of de-greasing, etching and de-smutting tend to leave a substantial level of surface contamination on the metal. This inhibits the reaction and adhesion of the chemical passivating agent and leaves areas with relatively poor protection. Although degreasing and other pre-treatment steps are still preferable when using plasma electrolytic oxidation technology, the high energy density of the process, and the resultant plasma discharge conditions, are sufficient to electrochemically clean the surface, and form a protective oxide film on previously greasy or smutty regions of the surface, or even areas where residue of mould-release agents has not been successfully removed prior to treatment. As such, even in one of its simplest embodiments as a two-step process, with either the plasma electrolytic oxidation step preceding the chemical passivation step, or the chemical passivation step preceding the plasma electrolytic oxidation step, embodiments of the present invention result in a more continuous level of surface corrosion protection because there will be no regions where surface contamination has inhibited action of the chemical passivating agent.

Embodiments of the present invention combine benefits of the two protection processes, namely the mechanical robustness of a plasma electrolytic oxide layer, the enhanced protection of convex corners or edges, the insensitivity to metal pre-treatment condition, the excellent base for impregnation or mechanical keying and adhesion of top-coats, the uniformity of the chemical passivation system, and the enduring, active chemical protection against corrosion provided by chemical passivation compounds.

Embodiments of the present invention also enable the use of relatively thin layers of plasma electrolytic oxide coating, as compared to conventional plasma electrolytic oxidation technology, while still maintaining the required corrosion performance. This represents an efficiency gain in terms of the required processing energy and time, but is also of great benefit where electrical continuity is required with adjoining metal parts (for example in electromagnetic shielding applications or where spot welding is to be performed) since this can only be achieved when the thickness of the electrically insulating plasma electrolytic oxide layer is sufficiently low to allow contact between surface asperities. The use of relatively thin layers of plasma electrolytic coating can allow electrical or galvanic continuity through the coating from the underlying metal to an adjoining conductive (e.g. metal) component, even when the coating itself is not electrically conductive. This is achieved by way of sharp surface asperities which may project through the coating, especially where the coated article is in high-pressure contact with another part, which can result in a degree of erosion or displacement of the coating. Ideally, the chemical passivation provides some active corrosion protection even if the physical ceramic coating layer is breached.

A further benefit of embodiments of the present invention is that plasma electrolytic oxidation coatings, since they require an electric field to generate them, have a limitation of throwing power into holes, crevices, recesses and other areas that are electrically shielded. On the other hand, chemical passivation requires only contact of the passivating liquid with the metal so has no such limitations. Therefore, the combination offers enhanced protection in the areas of the part that are shielded from the electric field in the plasma electrolytic oxidation process.

It is anticipated that a wide range of pre-treatments may be used with the process of the present invention. Although the plasma electrolytic oxidation step is relatively insensitive to the pre-condition of the surface, it may still be preferable to use a standard industrial cleaning or degreasing step in order to minimise contamination of the electrolyte subsequently used. Examples of alkali cleaning stage include aqueous solutions of NaOH or KOH with detergent additives that may be applied either by spraying or immersion. Those skilled in the practice of industrial pre-treatment for metals will recognise viable alternatives. Where the plasma electrolytic oxidation step follows a chemical passivation process, sometimes intermediate rinsing may be required to remove surplus passivation chemicals and sometimes no further intermediate steps may be needed, apart from any rinse or drying specified within the individual chemical passivation process.

Whenever a chemical passivation step is used prior to a plasma electrolytic oxidation step, a more extensive pre-treatment, (including, for example deoxidation in an acid solution wherever magnesium is being pre-treated) is still preferred, in order to maximise the effectiveness of the chemical passivation. All commercial chemical conversion coatings include recommendations for pre-treatments for particular alloy systems and it is expected that these would be used. Again, those skilled in the practice of chemical conversion treatment will recognise many suitable variants for the pre treatment of different metals for chemical passivation.

Some chemical passivation treatments require post-treatment rinses and/or drying, while others do not. Again, it is anticipated that the recommendations of the individual process be followed.

Wherever chemical passivation follows the plasma electrolytic oxidation step, intermediate rinses may be used to remove residual electrolyte from the surface and pore structure of the oxide layer. These may include a town water rinse, followed by a Dl water rinse, or pH-neutralising rinses.

EXAMPLES

Example 1

A multi-part magnesium case for electronic components made from AZ91D where electrical continuity (<5Ω contact resistance) is required between treated parts (in order to maintain electromagnetic shielding) and corrosion performance is to be sufficient to endure 96 hours of corrosion in salt for (ASTM B117) with less than 10% corroded area. #

Three different processing regimes were evaluated. For each, the pre-treatment regime was a typical industrially used sequence of commercially available proprietary chemicals:

i) 3 minute dip in Henkel Ridoline 305 caustic alkaline cleaner (~0.4% KOH and 0.1% anionic surfactant in Dl water)
ii) Town water rinse
iii) Dl water rinse
iv) 3 minute etch in Henkel HX 357 sulfuric acid etch (~0.8% $H_2SO_4$, 0.15% $H_2SiF_6$ in Dl water)
v) Town water rinse
vi) Dl water rinse Immediately following this pre-treatment, parts were processed in three distinct ways:

a) 1 minute phosphate-permanganate chemical conversion coating as described, for example, in WO 2004/022818
b) Plasma electrolytic oxidation for 30 seconds, but in other respects, as per example in WO 03/083181
c) Treatment (a) followed by an intermediate Dl water rinse and then treatment (b) for 20 seconds, but in other respects, as per example in WO 03/083181

Process (c) is thus an embodiment of the present invention, while (a) and (b) are examples of prior art.

The ohmic resistance of the three samples was evaluated using a resistance meter, with one probe in contact with a bare part of the substrate metal and a 20 mm diameter brass disc as the other contact point. The parts were then subjected to 120 hours of salt fog exposure (ASTM B117) and then inspected for corrosion and re-evaluated for contact resistance.

The results were as follows:

| Coating variant: | Ohmic resistance before corrosion: | Corrosion after 96 hours B117 salt fog exposure: | Ohmic resistance after corrosion: |
|---|---|---|---|
| a) Conversion coating only | <1 Ω | >75% area: general corrosion | >20 MΩ |
| b) Plasma electrolytic oxide only | <5 Ω | ~15% area: heavy corrosion | 50-20 MΩ |
| c) Combined coatings | <3 Ω | <5% area: mild corrosion | <5 Ω |

Thus, variant (c), which is one of the embodiments of the present invention, provides significantly better corrosion performance than either the conversion coating or the plasma electrolytic oxide coating in isolation, while also allowing adequate electrical continuity both before and after testing.

Example 2

Magnesium components made from AM50A alloy requiring a chrome-free pre-treatment for polyester powdercoat Akzo Nobel MN204E to meet or surpass the corrosion performance of an existing chromate based conversion coating.

Four processes were assessed—two examples of prior art and two embodiments of the present invention. All started with standard cleaning and etching steps based on commercially available, proprietary chemical systems from Chemetall PLC:

i) 2 minutes in alkali Cleaner Gardoclean S5167 (~0.1% KOH) at 50° C.
ii) 30 second tap water rinse
iii) 1 minute in Gardoclean S5240 (5 g/l ) at 40° C.
iv) 30 second tap water rinse
v) 30 second Dl water rinse This pre-treatment was followed by four different processing variants, two of which—a) and b)—represent prior art, and two of which—c) and d) represent embodiments of the present invention:

a) 3 minutes in Henkel Alodine 5200 (~0.04% $H_2TiF_6$ with additives in Dl water)
b) Plasma electrolytic oxidation for 3 minutes, but in other respects, as per example 2 in U.S. Pat. No. 6,896,785
c) Treatment with Alodine 5200 as per variant a), followed by plasma electrolytic oxidation as per variant b)

d) Plasma electrolytic oxidation as per variant b), followed by in intermediate Dl water rinse for 2 minutes, and then treatment with Alodine 5200 as per variant a)

The samples were then dried for 1 hour at 70° C. and powdercoated with a polyester-based powder coat (in this case Akzo Nobel MN204E). The samples were scribed and testing was performed which involved daily cycles of 15 minute immersion in 5% NaCl solution, drying, and 20 hour exposure to 90% relative humidity.

After 10 cycles of this test, variant a) showed signs of corrosion at the edges and in the vicinity of the scribe line. After 30 cycles, much of the powder coat had fallen off at the edges and significant blistering and corrosion creep up to 8 mm from the scribe line had occurred. After 40 cycles of the test, variant b) showed no sign of corrosion at the edges but some blistering and corrosion creep were visible up to 3 mm from the scribe line. On variants c) and d), the corrosion creep was maximum 1 mm from the scribe line.

Example 3

Aluminium 1050 architectural components, requiring pretreatment to ensure durability of polyester powdercoat in accelerated testing to satisfy architectural lifetime standards for a powdercoat 25 year guarantee.

The aluminium parts were all de-greased for two minutes at 55° C. by immersion in an alkaline solution including an anionic surfactant such as sodium or potassium tartrate (in this case, Chemetall "Gardoclean T5378" at 33 g/l: disodium tetraborate 10-25%, tetrasodium pyrophosphate 10-25%, fatty alcohol polyglycol ether 2.50-10%, and anionic surfactant at 1-2.5%), and rinsed for two minutes in de-ionised water. The parts were then treated according to several different pre-treatment methods prior to rinsing, drying and powdercoating; some (a, b and c) typical of chemical pre-treatment (as per the respective chemical manufacturers' guidelines) alone, one of plasma electrolytic oxidation alone (d), and three consisting of hybrid, synergistic processes representative of the present invention (e, f and g):

a) Immersion in an alkaline solution of a silane designed for surface activation and adhesion promotion (10 g/l of Chemetall's "Gardolene D6870" which includes 2.5-10% of 3-aminopropyl triethoxysilane) for 2 minutes at room temperature.

b) Immersion in an acidic solution of fluorozirconate (10 g/l of Chemetall's

"Gardobond X4707", which includes 1-2.5% of hexafluorotitanic acid) for 1 minute at room temperature.

c) Immersion in an acidic solution of fluorozirconate (50 g/l of Henkel's "Alodine 5200") for 1 minute at room temperature.

d) Plasma electrolytic oxidation processing for 5 minutes at 1 A per $dm^2$ in an alkaline electrolyte (as per U.S. Pat. No. 6,896,785).

e) PEO processing as per sample d), followed by a 2 minute rinse in de-ionised water and then immersion in an alkaline solution of silane as per sample a).

f) PEO processing as per sample d), followed by a 2 minute rinse in de-ionised water and then immersion in an acidic solution of fluorozirconate as per sample b).

g) PEO processing as per sample d), followed by a 2 minute rinse in de-ionised water and then immersion in an acidic solution of fluorozirconate as per sample c).

The samples were then dried for 1 hour at 70° C. and powdercoated with a polyester-based powder coat (in this case Akzo Nobel MN204E). Testing was then performed on scribed plates with cut edges, with 2000 hour acetic acid accelerated salt spray testing as per ISO 9227, and 2000 hour cyclic humidity testing as per BS 3900:F2.

The only samples to pass both of the 2000 hour tests (the respective pass criteria applied were corrosion on less than 5% of the surface and blistering on less that 5% of the surface, with undercutting limited to a maximum of 1.5 mm at the scribe or cut edges) were samples e), f) and g).

This confirms the synergistic element of the two technologies, with neither of the independent technologies fully satisfying the test criteria by themselves.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A process comprising:

a plasma electrolytic oxidation step on a surface of a valve metal that comprises surface asperities;

a chemical passivation step performed on the surface of the valve metal, wherein the combination of the plasma electrolytic oxidation step and the chemical passivation step forms an electrically insulating coating on the surface of the valve metal; and contacting the electrically insulating coating under high pressure with an adjoining metal component, wherein the electrically insulating coating is sufficiently thin that the surface asperities of the valve metal surface project through the electrically insulating coating to allow galvanic electrical continuity from the surface asperities to the adjoining metal component, and wherein the coating includes an oxide layer impregnated with a chemical passivating agent configured to provide active corrosion protection of the valve metal in an event of physical breach of the oxide layer.

2. A process according to claim 1, wherein the chemical passivation step precedes the plasma electrolytic oxidation step.

3. A process according to claim 1, wherein the plasma-electrolytic oxidation step precedes the chemical passivation step.

4. A process according to claim 1, wherein chemical passivation steps are performed both prior to and after the plasma-electrolytic oxidation step.

5. A process according to claim 3, wherein the plasma-electrolytic oxidation step generates an oxide coating having pores, and wherein the subsequent chemical passivation step does not physically seal the pores of the oxide coating.

6. A process according to claim 1, wherein the chemical passivation step comprises application of a liquid, the liquid not being in the form of a sol gel.

7. A process according to claim 1, wherein some or all of the surface of the valve metal is treated with the plasma-electrolytic oxidation step.

8. A process according to claim 1, wherein some or all of the surface of the valve metal is treated with the chemical passivation step.

9. A process according to claim 1, further comprising a pre-treatment regime of at least one of degreasing, etching or de-smutting to clean the surface of the valve metal prior to the plasma electrolytic oxidation and chemical passivation steps.

10. A process according to claim 1, further comprising a post-treatment regime consisting of at least one of rinses in water, pH-neutralising rinses, primer or sealer solutions.

11. A process according to claim 1, wherein the valve metal comprises at least one of magnesium, aluminium, titanium, tantalum, zirconium, chromium, vanadium, cobalt, hafnium, or molybdenum.

* * * * *